United States Patent [19]

Luke

[11] Patent Number: 4,525,161

[45] Date of Patent: Jun. 25, 1985

[54] METHOD FOR PRODUCING TOBACCO SMOKE FILTERS

[75] Inventor: John A. Luke, Hampshire, England

[73] Assignee: British-American Tobacco Company Limited, London, England

[21] Appl. No.: 466,150

[22] Filed: Feb. 14, 1983

Related U.S. Application Data

[62] Division of Ser. No. 269,702, Jun. 3, 1981, Pat. No. 4,388,934.

[30] Foreign Application Priority Data

Jun. 18, 1980 [GB] United Kingdom ..... 8019887

[51] Int. Cl.[3] ..... A24C 5/50

[52] U.S. Cl. ..... 493/42; 493/43; 493/45; 493/47; 493/49; 493/50; 131/341; 131/344

[58] Field of Search ..... 131/332, 331, 94, 95, 131/341, 344; 493/41, 42, 43, 45, 47, 49, 50

[56] References Cited

U.S. PATENT DOCUMENTS

| | | | |
|---|---|---|---|
| 2,688,380 | 9/1954 | MacHenry | 131/332 |
| 3,079,930 | 3/1963 | Coff | 131/343 |
| 3,805,682 | 4/1974 | Lyon et al. | 493/44 |
| 3,847,064 | 11/1974 | Berger | 493/44 |
| 4,024,012 | 5/1977 | Sigman | 493/45 |
| 4,292,032 | 9/1981 | Luke | 131/94 |

*Primary Examiner*—V. Millin

*Attorney, Agent, or Firm*—Kane, Dalsimer, Kane, Sullivan & Kurucz

[57] ABSTRACT

A method is disclosed for producing tobacco smoke filters wherein a continuous tube of smoke filtration material is ensheathed in a smoke-pervious layer of fibrous material. The ensheathed tube is cut into discrete lengths and in each of the lengths a cross section of the ensheathed material is rendered impervious to the passage of tobacco smoke and the tube is closed at a distance spaced longitudinally from the cross section.

10 Claims, 5 Drawing Figures

FIG. 1
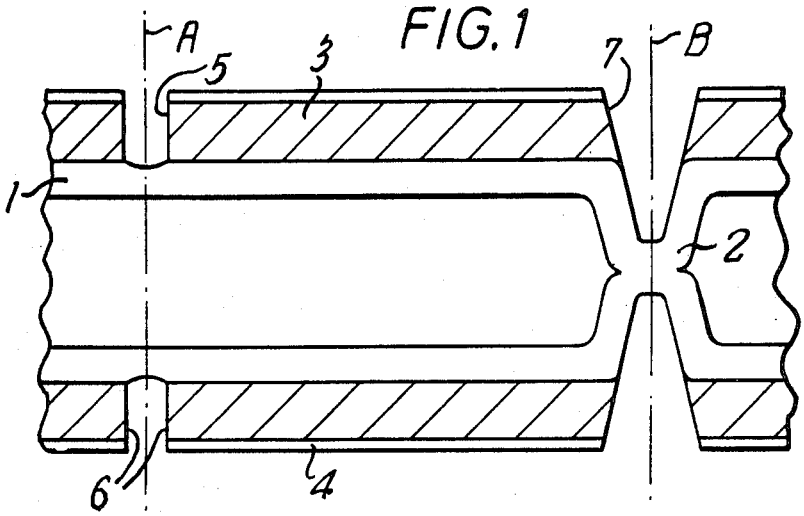
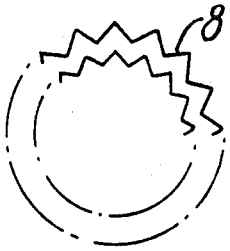
FIG. 2
FIG. 5
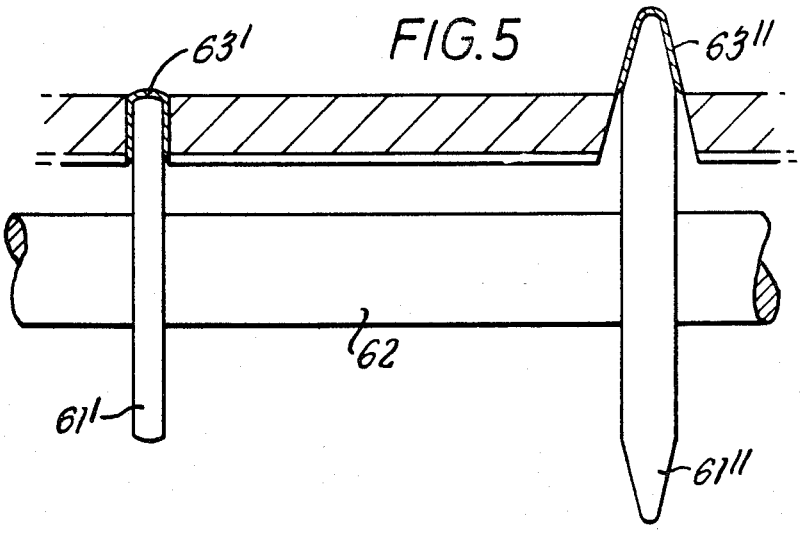

METHOD FOR PRODUCING TOBACCO SMOKE FILTERS

This is a division of application Ser. No. 269,702, filed June 3, 1981, now U.S. Pat. No. 4,388,934.

This invention concerns improvements relating to a method for producing filters for cigarettes and other smoking articles.

For the removal of particulate phase constituents from tobacco smoke it is common to provide a cigarette with a filter comprising a generally cylindrical plug of filtration material, cellulose acetate or paper for example. Another type of filter which has been proposed for the removal of particulate phase tobacco smoke constituents comprises an elongate hollow member of smoke filtration material which is disposed within a smoke impervious casing. There is provision in such latter type of filter to ensure that, at a longitudinal location of the hollow member, smoke is prevented from passing between the member and the surrounding casing, and further provision at a location of the hollow member longitudinally spaced from the aforesaid location for the purpose of obturating the interior of the hollow member. Thus smoke passing from the tobacco rod either first enters the interior of the hollow member and then flows in a generally radial direction through the wall of the hollow member and exits from the filter via the space between the hollow member and the casing, or, if the filter is reversed, the smoke flows in the opposite direction through the wall of the hollow member. In either case, the smoke in passing through the wall of the hollow member is subjected to a filtration action to remove particulate phase constituents of the smoke.

Filters of this latter type, which may be termed "tubular cross-flow filters", are useful in that for a given pressure drop experienced by the tobacco smoke passing through the filter, the filtration efficiency of the filter is higher than that obtainable with the first mentioned form of particulate phase filter. Tubular cross-flow filters are disclosed in, for example, United Kingdom Patent Specification Nos. 1,319,862 and 1,360,612 and U.S. Pat. Nos. 3,533,416 and 4,022,222.

Previously proposed tubular cross-flow filters present a variety of problems which make their manufacture difficult and/or costly. An object of the present invention is to provide a method and apparatus for producing a tubular cross-flow filter which is simple and economical to manufacture.

The present invention further provides a method of, producing tobacco-smoke filters, wherein a continuous tube of smoke-filtration material is fed to ensheathing means, fibrous material is fed to said ensheathing means whereby at exit from said ensheathing means said tube is ensheathed in a smoke-pervious layer of said fibrous material, the ensheathed tube is cut into discrete lengths and in each of said lengths a cross section of the layer of material is rendered impervious to the passage of tobacco smoke, and the tube of said length is closed at a location spaced longitudinally from said cross section of said ensheathing material.

The tube is preferably formed of a fibrous material of a thermoplastic character, in which case the closure thereof can be effected by heat and pressure, preferably after, but possibly before, the tube is ensheathed.

The tube may be formed wholly or substantially wholly of a synthetic material such as cellulose acetate or polypropylene, or regenerated cellulose.

The ensheathing material is also advantageously a fibrous material of thermoplastic character and is rendered impervious to the passage of tobacco smoke at the transverse cross section thereof by the application of heat which may be, suitably, accompanied by the application of pressure. The ensheathing material may for this purpose be subjected to a heat moulding process whereby an annular groove is produced, which groove is deep enough to extend at least to the outer surface of the underlying tube. The surfaces of the groove may if required be sealed by the application thereto of a barrier material.

In order that the invention may be clearly understood and readily carried into effect, reference will now be made, by way of example, to the accompanying diagrammatic drawings, in which:

FIG. 1 shows in axial section a portion of a filter rod;

FIG. 2 shows in transverse cross section a tubular diaphragm for use in a filter rod as shown in FIG. 1;

FIG. 5 shows parts of a filter rod as per FIG. 1 and parts of the apparatus of FIG. 4.

Figure 3:
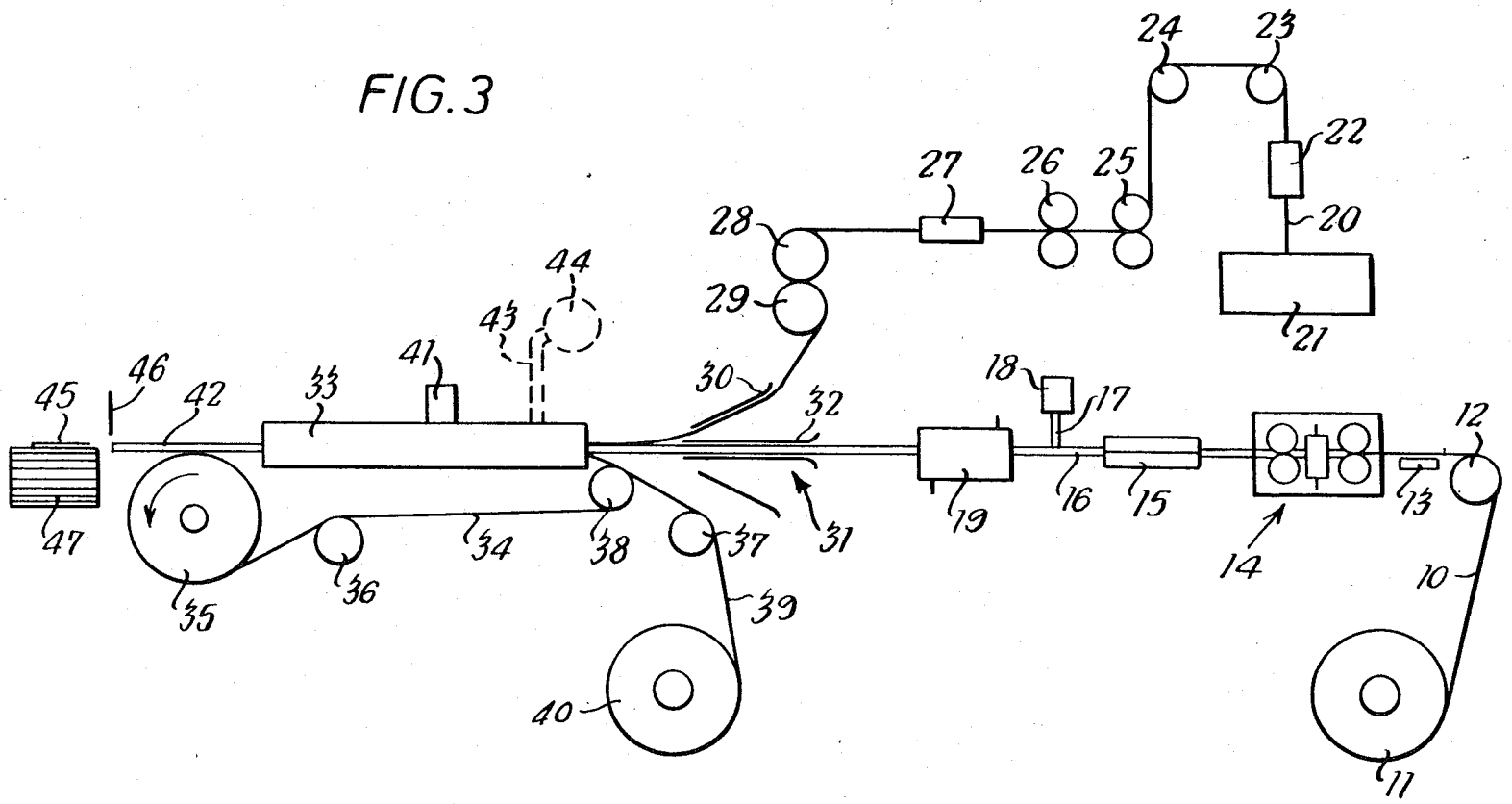
FIG. 3 shows apparatus for use in the manufacture of filter rod.

The filter rod shown in FIG. 1 comprises a tubular smoke-filtration diaphragm 1 formed of cellulose acetate and polypropylene fibres. At spaced locations (only one of which is shown) the tube 1 is closed by means of the walls therefore having been fused together. The region of fusing is denoted by reference numeral 2. The method of causing the fusing of the tube 1 is described below. The tube 1 is ensheathed in a layer 3 of cellulose acetate tow which in turn is wrapped in a substantially smoke impervious plugwrap 4 of a thermoplastic character. The plugwrap 4 may, for example, be composed of a mixture of cellulose acetate and polypropylene fibres. The filter rod is provided with a number of annular grooves, only one of which, denoted 5, is shown, which grooves are disposed intermediate the regions 2 at which the tube 1 has been closed. Each of the grooves 5 is formed by a spin-moulding technique, further described below, and the layer 3 of cellulose tow is sealed, as further described below, at cross sections 6, forming side surfaces of the groove 5, whereby at these cross sections the cellulose acetate tow is rendered impervious to the passage of tobacco smoke.

The filter rod of FIG. 1 is after manufacture cut into discrete filter elements. Thus the rod may be cut at planes, such as planes A and B, disposed centrally of the fused regions and the grooves 5 respectively. Each filter element thus obtained may be attached to a cigarette tobacco rod by the use of tipping in the usual manner. If the filter element is so attached to the tobacco rod that the closed end of the tube 1 is further from the tobacco rod, then smoke drawn from the tobacco rod will first enter the interior of the tube 1, passage directly into the ensheathing layer 3 being prevented by the sealing thereof at the cross section 6 constituting the upstream end of the layer 3. The closure of the downstream end of the tube 1 prevents any, or substantially any, smoke from passing axially out of the tube 1, and thus the smoke is induced to flow generally radially through the wall of the tube 1 into the layer 3, from which the smoke finally exits from the filter element at the unsealed downstream annular end surface, designated 7, of the layer 3.

The tube 1 can be formed with various cross sections. One possible alternative to a simple circular cross section is shown in FIG. 2. The tube 8 there depicted is of pleated form, which has the advantage of presenting to the smoke a larger tube wall area.

Figure 4:
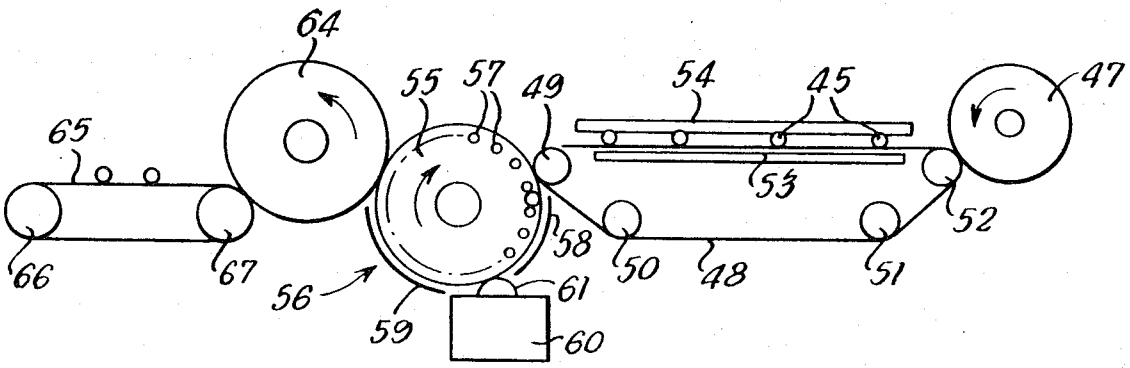
FIG. 4 shows further apparatus for use in association with the apparatus shown in FIG. 3.

Reference will now be made of FIGS. 3 and 4 which show apparatus by means of which filter rod such as above described can be produced. A web of thermoplastic smoke-filtration material 10, of cellulose acetate and polypropylene fibres for example, which may be of a thickness of 0.5 mm to 1 mm for example, is fed from a bobbin 11 around a pulley 12 to a pre-heater 13 which serves to preheat the web 10 before the web 10 enters a forming means 14. In its passage through the forming means 14, which means comprises a series of rollers provided with peripheral grooves, the web 10 is brought to a tubular form with the opposed edges of the web 10 in butting relationship. The tubiform web 10 next passes through a heated die 15 from which it emerges as self-sustaining tube stock 16. The butt joint of the tube stock 16 is then eased open by contact with a nozzle 17 of an adhesive applicator 18. Adhesive, which may be hot melt adhesive, issuing from the nozzle 17 is coated onto the opposed butt faces of the tube stock 16. After travelling a short distance onwards from the nozzle 17 the opposed butt faces are brought together again by virtue of the resilience of the wall of the tube stock 16. Reference numeral 19 designates a cooling device which serves, when hot melt adhesive is used, to promote fast setting of the adhesive. A coolant, chilled water for example, is circulated through the cooler 19 by circulator means (not shown). This method of tube formation is generally similar to that described in United Kingdom Patent Specification No. 1,311,437.

Continuous filamentary tow 20 formed of cellulose acetate, polypropylene or other tow material passes, from a bale 21 thereof, through an air banding jet device 22, around guide rollers 23, 24 to a blooming device comprising first and second pairs of rollers 25 and 26. As is well known in the art, in such blooming devices the first encountered rollers (25) are driven at a rotary speed which is less than that of the second encountered rollers (26). After being bloomed, the tow 20 is passed through a cabinet 27 in which the tow 20 is sprayed with a suitable plasticiser for the tow. From the cabinet 27 the tow is trained about guide rollers 28, 29 and then passes into a conical guide 30, of a guide means 31.

The guide means 31 also comprises a guide tube 32 axially disposed of the conical guide 30, through which guide tube is fed the tube stock 16 emerging from the cooling device 19. Thus, when the tube stock 16 passes out of the downstream end of the guide tube 32, it becomes enveloped in tow 20 passing out of the downstream end of the conical guide 30. The tube stock 16 and the tow 20 are then together fed through a garniture 33 through which passes an endless garniture tape 34 which exteriorly of the garniture 33 is trained about pulleys 35, 36 and 38. Pulley 35 is rotatable by drive means (not shown). Fed onto the garniture tape 34 is plugwrap web 39 supplied from a bobbin 40 and trained about a pulley 37. The garniture 33 is provided with a seam-adhesive applicator 41 which is operative to apply adhesive at an edge margin of the plugwrap web 39. The garniture 33 and the garniture tape 34 are operative in the usual manner so that wrapped filter rod 42 issued from the garniture.

As an alternative to plugwrap being supplied to the garniture 33 for the production of wrapped rod, the garniture 33 may be fitted with a steam pipe 43 communicating with a source of steam 44, the arrangement being such that steam supplied to the garniture 33 via the pipe 43 passes through the garniture tape 34 (which obviously must be of a material able to withstand the effects of steam) into tow 20. By use of such a modified garniture and of an appropriate tow/plasticiser combination, the tow 20 may be rendered selfsustaining.

The filter rod 32, wrapped or self-sustaining, is cut into discrete lengths 45, each a multiple of the length of a single filter element, by a cutting device 46. A fluted take-off drum 47 serves to receive the rod lengths 45 and to deposit them on an endless band 48 trained about rollers 49–52-see FIG. 4.

The upper run of the band 48 extends over a flat metal support plate 53. A number of elongate, heatable formers 54 are disposed above the upper run of the band 48 and extend in the direction of travel of the band 48. The take-off drum 47 and the endless band 48 are driven by drive means (not shown). Travel of the upper run of the band 48 causes the rod lengths thereon to be rolled in contact with the heated formers 54. This results in the formation of annular sealing grooves in the tow, exemplified by groove 5 of FIG. 1, and in the production of fused regions of the tube stock 16 as per the region 2 of FIG. 1. If the tube stock 16 is of a thermoplastic character, the sealing grooves may be of such depth as to extend into, but not through, the wall of the tube stock 16. This is illustrated in FIG. 1 in that the groove 5 extends into the tube 1. The heated formers 54 which serve to deform the tube stock 16 in the formation of the fused regions thereof; which formers may be termed "fusing formers", extend nearer to the upper run of the band 48 then do those of the heated formers 54 which serve to form the sealing grooves, which latter may be termed "grooving formers". Moreover, the cross sectional profile of the fusing formers 54 is of V form. Thus the deformation of the tube stock 16 brought about in the formation of each fuseed region thereof results in an annular groove of V-section in the tube stock 16, the side faces of the groove being extended through the ensheathing tow 20 and, of course, the plugwrap 39. One such groove is shown at the right hand end of the rod portion of FIG. 1.

There is disclosed in the specification of our United Kingdom Patent No. 1,507,765 an alternative form of apparatus suitable for forming the annular sealing grooves and the fused regions.

The grooved rod lengths pass from the band 48 onto a conveyor drum 55 of an applicator unit 56. Mounted around the periphery of the drum 55 are small diameter driven support rollers 57 the axes of which are parallel to the axis of the roller 55. Arcuate retaining members 58, 59 are provided to ensure that each rod length 45 is held in contact with a pair of the rollers 57, whereby the rod length is caused to rotate. The applicator unit 56 further comprises a bath 60, a number of applicator discs 61 only an end of which is shown in FIG. 4. The applicator discs 61 are of two forms 61' and are fixedly mounted alternately on a common shaft 62 (see FIG. 5). The conveyor drum 55, the support rollers 57 and the shaft 62 are driven by drive means (not shown).

As may be observed from FIG. 5, rotation of the drum 55 brings each filter rod length 45, supported in contact with a pair of the support rollers 57 of the drum 55, into a position in which an upper portion of each of the applicator discs 61' enters a respective one of the sealing grooves of the rod length 45 and similarly an upper portion of each of the applicator discs 61' enters a respective one of the grooves formed in the rod length 45 by fusing formers 54. As the applicator discs 61', 61'' rotate, lower portions thereof are immersed in molten barrier material in the bath 60 and thus the barrier material is deposited in each of the grooves of the rotating rod lengths 45. The barrier material solidifies to form annular seals as indicated by hatched zones 63' and 63''. An applicator unit similar to unit 56 is described in United Kingdom Patent Specification No. 2033207.

The rod lengths 45 pass from the drum 55 of the applicator unit 56 to a fluted transfer drum 64 which serves to transfer the rod lengths to an endless band 65 which is trained about pulleys 66, 67. The drum 64 and the band 65 are drivable by drive means (not shown). From the band 65 the rod lengths may be passed to further machinery for incorporation of individual filter elements in cigarettes.

Although in the process described above barrier material is deposited to form annular seals 63' and 63'' it may be found in some circumstances that the spin moulding process results in a sufficient degree of sealing to render one or both of these annular seals unnecessary.

What is claimed is:

1. A method of producing tobacco smoke filters including the steps of, feeding a continuous tube of smoke filtration material to ensheathing means, feeding fibrous material to said ensheathing means whereby at exit from said ensheathing means said tube is ensheathed in a layer of smoke-pervious layer of said fibrous material, cutting the ensheathed tube into discrete lengths, and in each of said lengths, rendering a cross-section of the ensheathing material impervious to the passage of tobacco smoke, and closing the tube of said length at a location spaced longitudinally from said cross section of said ensheathing material.

2. A method according to claim 1 including the steps of forming the tube of a thermoplastic material and effecting the closure thereof by heat.

3. A method according to claim 2 wherein the closure is effected after the tube is ensheathed.

4. A method according to claim 1, 2 or 3 including the steps of forming the layer of ensheathing material of a thermoplastic material and rendering the layer impervious to the passage of tobacco smoke at the cross-section thereof by the application of heat.

5. A method according to claim 1 including the steps of forming the tube of a thermoplastic material and effecting the closure thereof by heat and pressure.

6. A method according to claim 1, 2 or 3 including the steps of forming the layer of ensheathing material of a thermoplastic material and rendering the layer impervious to the passage of tobacco smoke at the cross-section thereof by the application of heat and pressure.

7. A method according to claim 4 including the steps of subjecting the layer of ensheathing material to a heat moulding process whereby an annular groove is produced, which groove is deep enough to extend at least to the outer surface of said tube.

8. A method according to claim 7 wherein said groove is sealed by the application thereof of a barrier material.

9. Apparatus for producing tobacco smoke filters including means to form a continuous tube of smoke filtration material, ensheathing means, feeding means to feed fibrous material to said ensheathing means, said ensheathing means ensheathing the tube in a layer of smoke pervious material, cutting means to cut the ensheathed tube into discrete lengths, means to render a cross section of the ensheathing layer impervious to the passage of tobacco, and means to close the tube at a location spaced longitudinally from said cross section of the ensheathing layer.

10. Apparatus according to claim 9 wherein the means to render said cross section of the layer impervious comprises at least one heatable former along which said lengths are rolled, said at least one former being shaped to form an annular sealing groove in said layer and at least one further former shaped to close said tube is provided spaced laterally relative to.

* * * * *